United States Patent [19]

Black

[11] 4,223,866

[45] Sep. 23, 1980

[54] ADJUSTABLE BRACKET

[75] Inventor: Noel S. Black, Hydro, Okla.

[73] Assignee: Brown Company, Pasadena, Calif.

[21] Appl. No.: 795,648

[22] Filed: May 10, 1977

Related U.S. Application Data

[63] Continuation-in-part of Ser. No. 681,155, Apr. 28, 1976, abandoned.

[51] Int. Cl.[3] ..... E04G 17/18

[52] U.S. Cl. ..... 249/211; 52/702; 249/24

[58] Field of Search ..... 249/19, 23–25, 249/187, 188, 211, 219 R; 52/702, 708

[56] References Cited

U.S. PATENT DOCUMENTS

| | | | |
|---|---|---|---|
| 3,917,214 | 11/1975 | Ratcliff et al. | 249/211 |
| 3,954,248 | 5/1976 | Barber | 249/211 |

FOREIGN PATENT DOCUMENTS

| | | | |
|---|---|---|---|
| 1095251 | 5/1955 | France | 52/702 |

*Primary Examiner*—John McQuade

*Attorney, Agent, or Firm*—Smyth, Pavitt, Siegemund, Jones & Martella

[57] ABSTRACT

The bracket is of a U-shaped structure with an adjustably positioned plate for removably receiving a joist. The plate is held on a bolt which is threadedly received in another plate being held in the U-structure, and an L-shaped element is secured to the structure for depending the bracket from a beam.

12 Claims, 4 Drawing Figures

ADJUSTABLE BRACKET

This is a Continuation-In-Part application of Ser. No. 681,155, filed Apr. 28, 1976, now abandoned.

BACKGROUND OF THE INVENTION

The present invention relates to support devices, and more particularly, to adjustable, concrete form bracket.

It is, therefore, the principal object of this invention to provide an adjustable concrete bracket, which will be of the hanger type.

Another object of this invention is to provide a bracket of the type described, which will save approximately 20% on labor installing and erection, and approximately 30% on labor in removing and wrecking out deck forms.

Another object of this invention is to provide an adjustable concrete form bracket, which will be particularly adaptable for bridge decks on pre-stressed concrete beams, "I" beams and bridge type box culverts.

A further object of the present invention is to provide a bracket of the type described, which may also be used to form concrete tops on basements, storm cellars, and also decks and floors in multi-story buildings.

Other objects of the invention are to provide an adjustable concrete form bracket, which is simple in design, inexpensive to manufacture, rugged in construction, easy to use and efficient in operation.

SUMMARY OF THE INVENTION

In accordance with the preferred embodiment of the present invention, it is suggested to provide an adjustable, concrete form bracket for being used in pairs and being comprised of a pair of spaced-apart side walls extending in parallel from a rear wall; and L-shaped member is connected to the bracket for depending the bracket from a beam; and means such as a plate is provided to support and position a joist between the side walls; this support means, e.g., the plate is preferably held on a threaded bolt, threadedly received in another plate which is removably positioned in a particular position between the side walls. A U-shaped strap with a bolt fastener permits vertical alignmemt and orientation of the bracket.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
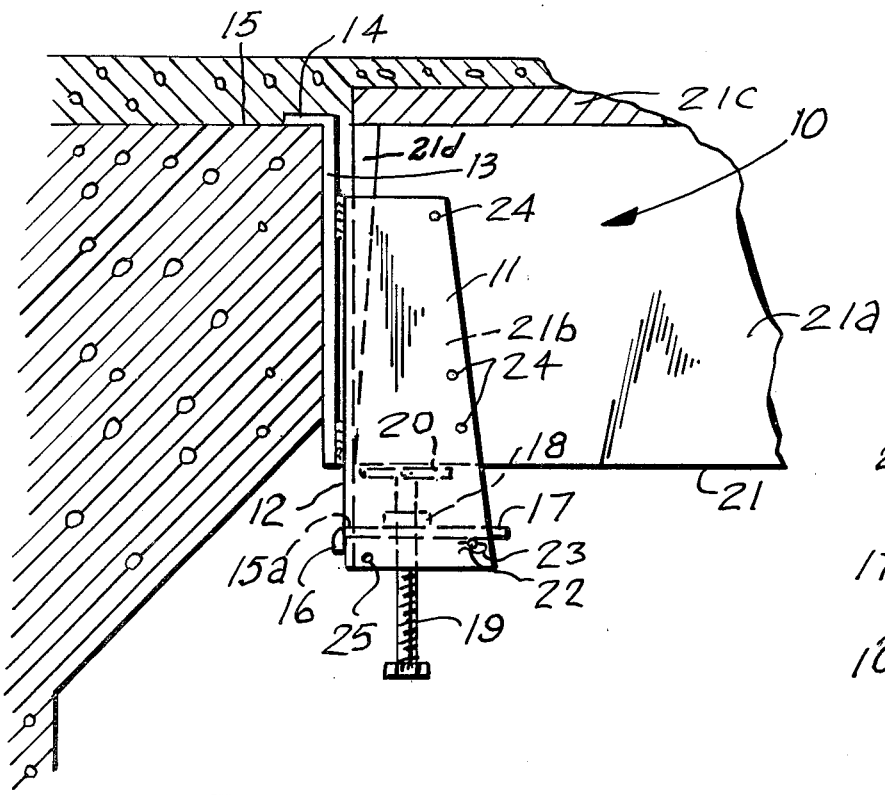
FIG. 1 is a side view of the present invention, shown in use.

According to this invention, an adjustable concrete form bracket 10 is shown to include a pair of parallel spaced-apart side walls 11 and a rear wall 12, to establish a structure of U-shaped cross-section in horizontal cross-section or top elevation.

An L-shaped member or plate 13 is connected to the bracket, e.g. welded to rear wall 12. The short leg of L-shaped plate 13 is configured as a tapered lip 14 and extends above the rear wall 12, for engaging the upper corner of a prestressed concrete beam 15. An elongated opening **15*a* through rear wall 12, removably receives the lip 16 of L-shaped plate 17. A nut fastener 18 is secured fixedly, by welding or other suitable means, to plate 17, and threadably receives a bolt fastener 19. A plate 20 is rotatably secured to the end of bolt fastener 19; this way, the plate is positioned inside of bracket 10 between the side walls 11. The plate 20 abuts with the underside 21 of a joist 21*a* to position and to support that joist. The end of joist 21*a* is received within the opening 21*b*, defined by side walls 11 of bracket 10. A wedge 21*d* is interposed between the rear wall 12 and joist 21*a***.

Figure 2:
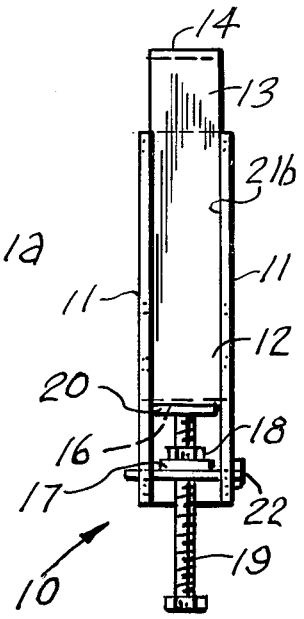
FIG. 2 is a right end view of the invention, shown in elevation, and removed from FIG. 1.

As will be readily seen in FIGS. 1 and 2 of the drawing, plate 17 provides support means for joist **21*a* in an adjustable manner, through the use of bolt fastener 19, threaded into the nut fastener 18 of plate 17. The extending end of plate 17 is supported upon removable pin 22, which receives a key 23**.

Side walls 11 are provided with a plurality of spaced-apart openings 24 along their respective angular side edges, and openings 25 in each of the lower portions of side walls 11 are provided, for a purpose which will hereinafter be described. The openings 24 provide a means of receiving nail fasteners. Brackets 10 are used in pairs and positioned to oppose each other and the ends of joist **21*a* are spaced sufficiently from the rear walls 12, so as to enable the joist 21*a* to be lowered, after removing the nails and pin. After the plyforms 21*c* are removed, the shell of the bracket 10 is removed by prying it out of the concrete 15, the wedge lip 14 hung over the top of the beam 15**, which should have been greased or booted with plastic or a rubber cover, so that the concrete will not bond to the metal.

Prior to removing brackets 10, the pin 22 is removed, so as to enable the joist **21*a* to be dropped from the opening 21*b***.

Figure 3:
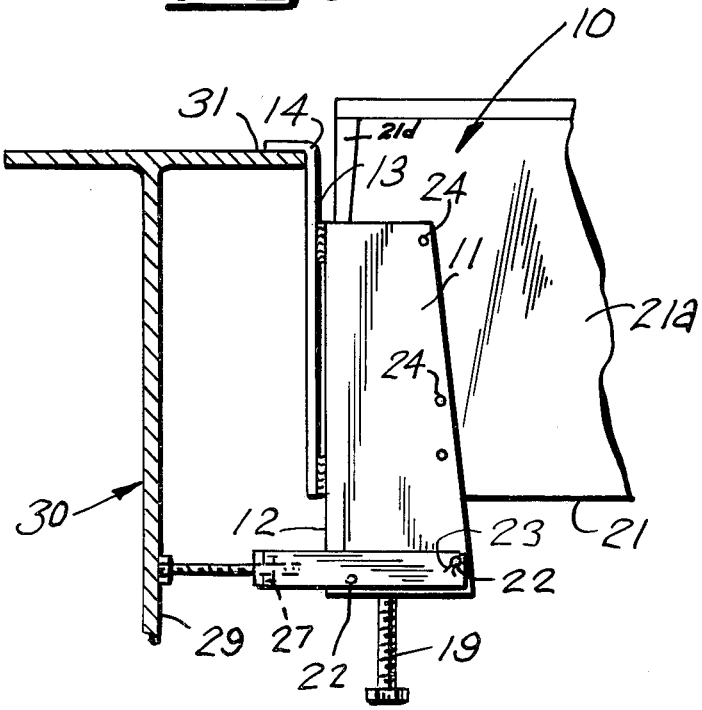
FIG. 3 is similar to FIG. 1, but shows the device with an adjustable support added thereon, for use on steel beams and plate girders.
Figure 4:
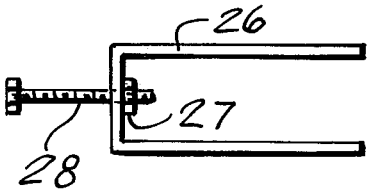
FIG. 4 is a plan view of the adjustable support, shown removed from FIG. 3.

Referring now to FIGS. 3 and 4 of the drawing, a U-shaped strap 26 is shown to include a nut fastener 27, threaded onto bolt fastener 28, the head of which abuts with the web 29 of wide flanged "I" beam 30. U-shaped strap 26 is removably secured to side walls 11 by means of pins 22 receiving each a key 23. One of these pins 22 was mentioned earlier as support for plate 17, therefore, this particular pin fulfills a double function: It supports plate 17 and fastens strap 26. The latter strap is additionally fastened by a second pin 22 traversing openings 25 and being held by a key similar to key 23. The tapered lip 14 of plate 13 serves to abut with and engage the outer peripheral side edge 31 of beam 30. With the above mentioned arrangement, the support is similar to that heretofore described of FIGS. 1 and 2.

The invention is not limited to the embodiments described above but all changes and modifications thereof not constituting departures from the spirit and scope of the invention are intended to be included.

I claim:

1. An adjustable bracket for being depended from a beam and for being used in pairs as joist hangers, comprising:

wall means including a pair of spaced-apart side walls connected to and extending in parallel from a rear wall, there being no top wall so as to permit a joist to be placed from above and/or to extend above the side walls when positioned and held between the side walls;

an L-shaped element affixed to the rear wall and adapted for depending the bracket from a beam;

first means disposed between the side walls adapted for supporting and positioning the joist in a particular position when received within the bracket and holding the bottom of the joist between the side walls; and second means removably connected to the wall means for positioning and holding the first means between the side walls in a vertically adjustable position and for removing the first means from between the side walls upon being removed from the wall means to permit dropout of a supported joist.

2. An adjustable bracket as set forth in claim 1, wherein said element extends above the rear wall.

3. An adjustable bracket as set forth in claim 1, said L-shaped element having a short leg configured as a tapered lip.

4. An adjustable bracket as set forth in claim 1, said side walls having opening adapted for receiving nails to be entered into said joist.

5. An adjustable bracket for being depended from a beam and for being used in pairs as joist hangers, comprising:

wall means including a pair of spaced-apart side walls connected to and extending in parallel from a rear wall;

an L-shaped element affixed to the rear wall and adapted for depending the bracket from a beam;

first plate and a bolt fastener, said first plate being freely movable between said side walls and being removable from between said side walls but being held by the bolt fastener; and a second plate removably connected to the wall means and being provided for threadedly receiving the bolt fastener to thereby hold the first plate between the side walls.

6. An adjustable bracket as in claim 5, said second plate being held between said side walls.

7. An adjustable bracket as set forth in claim 6, said rear wall having an opening, said second plate being received by said opening; and pin means inserted in the side walls for additionally holding the second plate.

8. An adjustable bracket as set forth in claim 7, said second plate having an L-shaped configuration.

9. An adjustable bracket as in claim 5, wherein said second plate is provided with a nut fastener for threadedly receiving the bolt fastener.

10. An adjustable bracket for being depended from a beam and for being used in pairs as joist hangers, comprising:

wall means including a pair of spaced-apart side walls connected to and extending in parallel from a rear wall;

an L-shaped element affixed to the rear wall and adapted for depending the bracket from a beam;

first means removably disposed between said side walls and adapted for supporting and positioning a joist in a particular position;

second means positioned and held between said side walls for positioning and holding the first means between the side walls; and adjustable means connected to the wall means and extending beyond the rear wall for adjusting and positioning the lower end of the bracket.

11. An adjustable bracket as set forth in claim 10, said adjustable means including a U-shaped strap and a bolt threadedly received by the U-shaped strap and provided for bearing against a portion of the beam from which the bracket is to be depended.

12. An adjustable bracket as in claim 5 or 10, said spaced-apart side walls not being interconnected at their top to permit a joist to be inserted in-between the wall means and from above.

* * * * *